US012768351B2

(12) United States Patent
Merkle et al.

(10) Patent No.: US 12,768,351 B2
(45) Date of Patent: Oct. 20, 2026

(54) PUMP ARRANGEMENT

(71) Applicant: VALEO EMBRAYAGES, Amiens Cedex (FR)

(72) Inventors: Manuel Merkle, Ebern (DE); Roland Stoessel, Ebern (DE); Anton Sauter, Ebern (DE); Vladimir Nickel, Ebern (DE); Patrick Gegner, Ebern (DE)

(73) Assignee: VALEO EMBRAYAGES, Amiens Cedex (FR)

( * ) Notice: Subject to any disclaimer, the term of this patent is extended or adjusted under 35 U.S.C. 154(b) by 0 days.

(21) Appl. No.: 19/062,372

(22) Filed: Feb. 25, 2025

(65) Prior Publication Data

US 2025/0270994 A1 Aug. 28, 2025

(30) Foreign Application Priority Data

Feb. 27, 2024 (DE) ..... 102024105464.6

(51) Int. Cl.
*F04C 11/00* (2006.01)
*F04B 17/03* (2006.01)
*F04B 23/04* (2006.01)

(52) U.S. Cl.
CPC ..... *F04C 11/008* (2013.01); *F04B 17/03* (2013.01); *F04B 23/04* (2013.01); *F04C 11/005* (2013.01);
(Continued)

(58) Field of Classification Search
CPC ..... F04C 11/00–008; F04C 17/03; F04C 2240/30; F04C 2240/40; F04C 2240/808; F04B 23/04
(Continued)

(56) References Cited

U.S. PATENT DOCUMENTS 3,306,228 A * 2/1967 Drutchas ..... F04C 2/18 418/192
4,738,584 A * 4/1988 Price ..... F04D 29/426 415/203
(Continued)

FOREIGN PATENT DOCUMENTS

DE 4021411 C2 * 9/1993 ..... H02K 5/22
DE 19511170 A1 * 10/1996 ..... F04D 15/029
(Continued)

OTHER PUBLICATIONS

French Preliminary Search Report Issued Feb. 27, 2024 in French Application 10 2024 105 464.6 filed on Oct. 29, 2024, 8 pages.
(Continued)

*Primary Examiner* — Alexander B Comley
(74) *Attorney, Agent, or Firm* — Oblon, McClelland, Maier & Neustadt, L.L.P.

(57) ABSTRACT

A pump module for a drive unit of a motor vehicle, includes a housing module having an electronics housing and a pump housing, a circuit board which is received in the electronics housing and is equipped with electronic components. At least one connector plug is provided on the electronics housing and has electrical contacts which are electrically connected to conductors of the circuit board. Two hydraulic pumps are mounted in the pump housing and each have an electric motor, wherein the pump housing is axially mounted on the electronics housing.

19 Claims, 5 Drawing Sheets

(52) U.S. Cl.
CPC ..... *F04C 2240/30* (2013.01); *F04C 2240/40* (2013.01); *F04C 2240/808* (2013.01)

(58) Field of Classification Search
USPC ..... 417/2–8
See application file for complete search history.

(56) References Cited

U.S. PATENT DOCUMENTS

| | | | | |
|---|---|---|---|---|
| 6,579,070 | B1 * | 6/2003 | Birkenmaier | F04C 11/005 418/259 |
| 8,128,377 | B2 * | 3/2012 | Earhart | F04C 14/226 417/2 |
| 9,587,639 | B2 * | 3/2017 | Rosinski | F04D 29/4206 |
| 11,732,719 | B2 * | 8/2023 | Lechner | F04D 15/029 417/2 |
| 12,276,281 | B2 * | 4/2025 | Badt | F04D 29/043 |
| 2003/0012664 | A1 * | 1/2003 | Maier | F04C 11/008 417/310 |
| 2012/0230850 | A1 * | 9/2012 | Kawano | F04C 15/0096 417/410.1 |
| 2013/0294928 | A1 * | 11/2013 | Rosinski | H02K 11/00 417/5 |
| 2015/0308435 | A1 * | 10/2015 | Rosinski | F04D 29/053 417/2 |
| 2018/0180043 | A1 * | 6/2018 | Miyazawa | F04C 14/223 |
| 2020/0208629 | A1 * | 7/2020 | Valkenberg | F04C 11/005 |
| 2021/0285443 | A1 * | 9/2021 | Jäggle | F04C 2/102 |
| 2021/0367475 | A1 * | 11/2021 | Stoessel | H02K 5/04 |
| 2022/0163035 | A1 * | 5/2022 | Krause | F01C 21/10 |
| 2022/0403843 | A1 * | 12/2022 | Stoessel | F04C 11/001 |
| 2023/0121945 | A1 * | 4/2023 | Badt | F04D 29/086 417/423.5 |
| 2023/0383748 | A1 * | 11/2023 | Zhang | F04B 53/08 |
| 2023/0407881 | A1 * | 12/2023 | Stoessel | F04D 29/406 |

FOREIGN PATENT DOCUMENTS

| | | | | |
|---|---|---|---|---|
| DE | 102011076060 | A1 * | 11/2012 | F02D 41/3854 |
| DE | 102012204212 | A1 * | 9/2013 | H02K 11/33 |
| DE | 102020100595 | A1 * | 7/2021 | F04C 11/008 |
| DE | 102020106849 | A1 * | 9/2021 | F04B 49/06 |
| DE | 102021101096 | A1 * | 7/2022 | F04D 13/0686 |
| DE | 102012204212 | B4 * | 2/2024 | F04D 13/14 |
| JP | 2000130387 | A * | 5/2000 | |
| JP | 2003027912 | A * | 1/2003 | F04C 2/356 |
| JP | 2004162541 | A * | 6/2004 | |
| JP | 2013199844 | A * | 10/2013 | F04C 11/005 |
| KR | 101256198 | B1 * | 4/2013 | F01P 5/12 |
| WO | WO-2013037449 | A2 * | 3/2013 | F04D 13/06 |
| WO | WO-2014143475 | A1 * | 9/2014 | F04D 29/426 |
| WO | WO-2022157077 | A1 * | 7/2022 | F04D 29/426 |

OTHER PUBLICATIONS

Extended European Search Report issued Jul. 16, 2025, in corresponding European Patent Application No. 25157243.4, 6 pages.

* cited by examiner

PUMP ARRANGEMENT

BACKGROUND OF THE INVENTION

FIELD OF THE INVENTION

The invention relates to a pump arrangement for a drive unit of a motor vehicle.

Description of the Related Art

Such a pump arrangement may be used in a motor vehicle in order to lubricate and/or cool the drive unit, in particular an electric motor of an electric axle and/or a clutch. If multiple pumps are provided, these are usually formed separately and fitted in the motor vehicle independently of one another. Because of the many components which now have to be installed in motor vehicles, the installation space and the possibilities for fastening one or more pumps to the motor vehicle are greatly limited. Accordingly, complicated arrangements result when multiple pumps must be fitted in the vicinity of the drive unit.

BRIEF SUMMARY OF THE INVENTION

It is an object of the invention to provide a pump arrangement which requires as little installation space as possible and is simple to fasten.

This object is achieved according to the invention by a pump module for a drive unit of a motor vehicle, with a housing module having an electronics housing and a pump housing, a circuit board which is received in the electronics housing and is equipped with electronic components, at least one connector plug which is provided on the electronics housing and has electrical contacts which are electrically connected to conductors of the circuit board, and two hydraulic pumps which are mounted in the pump housing and each have an electric motor, wherein the pump housing is axially mounted on the electronics housing. Such a pump arrangement can easily be fitted, in particular in the axial direction. Furthermore, it is compact so that it can easily be accommodated even when spatial conditions are restricted. Since the two hydraulic pumps are connected together by their mounting on the common pump housing, only one component need be installed in the motor vehicle and connected to the drive unit.

Preferably, the pump module is a pump module for an electric vehicle and is arranged in an oil sump of the motor vehicle. With a view to a low vehicle weight, the trend is towards ever smaller oil sumps, whereby the space available for receiving the pump module becomes ever smaller. From this aspect, the compactness of the pump module is particularly advantageous.

The axial direction here corresponds to the orientation of the rotational axis of the rotor of the electric motor According to an embodiment, the electric motors each have a rotor coupled to one of the hydraulic pumps and a stator received in the pump housing, wherein the stators are at least partially exposed on an outside of the housing module. Because of this, when the pump module is arranged in an oil sump, oil can wash directly around the stator. This allows the stator to be cooled without requiring a separate, costly coolant circuit.

Preferably, the stators are placed in a trough-like portion of the housing module, so that they are mechanically guided on one side and can be premounted on the housing module.

According to an embodiment, the stators are at least partially inserted into the pump housing, whereby the stator is reliably positioned relative to the pump housing.

Preferably, the stators are fixed in the axial direction between the housing and the hydraulic pumps, wherein the hydraulic pumps are bolted to the pump housing. This allows the pump module to be fitted in a single direction, specifically in the axial direction.

According to an embodiment, the connector plug has a collar which is provided and configured to extend through an opening of an oil sump and seal there. By means of the connector plug, the pump module can be directly connected to the vehicle electronics without separate plugs or cables being required. At the same time, the connector plug reliably seals through the passage opening of the oil sump.

Preferably, the plug-in directions of the connector plug run parallel to the extent plane of the circuit board. This achieves a compact design since the contacts of the connector plug can extend straight, directly from an edge of the circuit board.

According to a preferred embodiment, the first hydraulic pump is a vane pump and the second hydraulic pump is a gear pump. With this combination, different hydraulic flows can be provided, namely firstly a high volume flow with lower pressure and secondly a lower volume flow with high pressure.

Evidently, other pumps may be used instead of the vane pump and the gear pump. Here, it is important only that the intake openings are provided on the same side as the connector plug.

One of the hydraulic pumps may have an extension housing which has an intake opening on its underside and a delivery opening on a side facing away from the hydraulic pump. Such an extension housing is provided in particular for a vane pump, since this requires a comparatively large intake surface area. Accordingly, preferably the entire underside of the extension housing is provided as an intake opening which is defined by an injection-moulded filter. The cavity inside the extension housing may here be used as an oil store, so that it is not necessary to enlarge the oil sump in which the pump module is arranged.

Two connector plugs may be provided, so that a dedicated connector plug is assigned to each of the hydraulic pumps.

According to an embodiment, a circuit board is provided which is electrically divided into two portions which are separate from one another. Alternatively, it may be provided that two circuit boards are provided. Thus the electronics of the two hydraulic pumps are mechanically connected together but electrically separated from one another. Accordingly, the hydraulic pumps can be actuated independently of one another.

According to an embodiment, a potting compound is provided so that the electronic components are encapsulated fluid-tightly in the electronics housing.

According to a preferred embodiment, the electric motors of the hydraulic pumps are here identical. This allows an at least partially modular structure of the pump module and leads to lower production costs.

BRIEF DESCRIPTION OF THE SEVERAL VIEWS OF THE DRAWINGS

Further features and advantages of the invention will emerge from the following descriptions and from the figures, to which reference is made. In the figures.

DETAILED DESCRIPTION OF THE INVENTION

Figure 1:
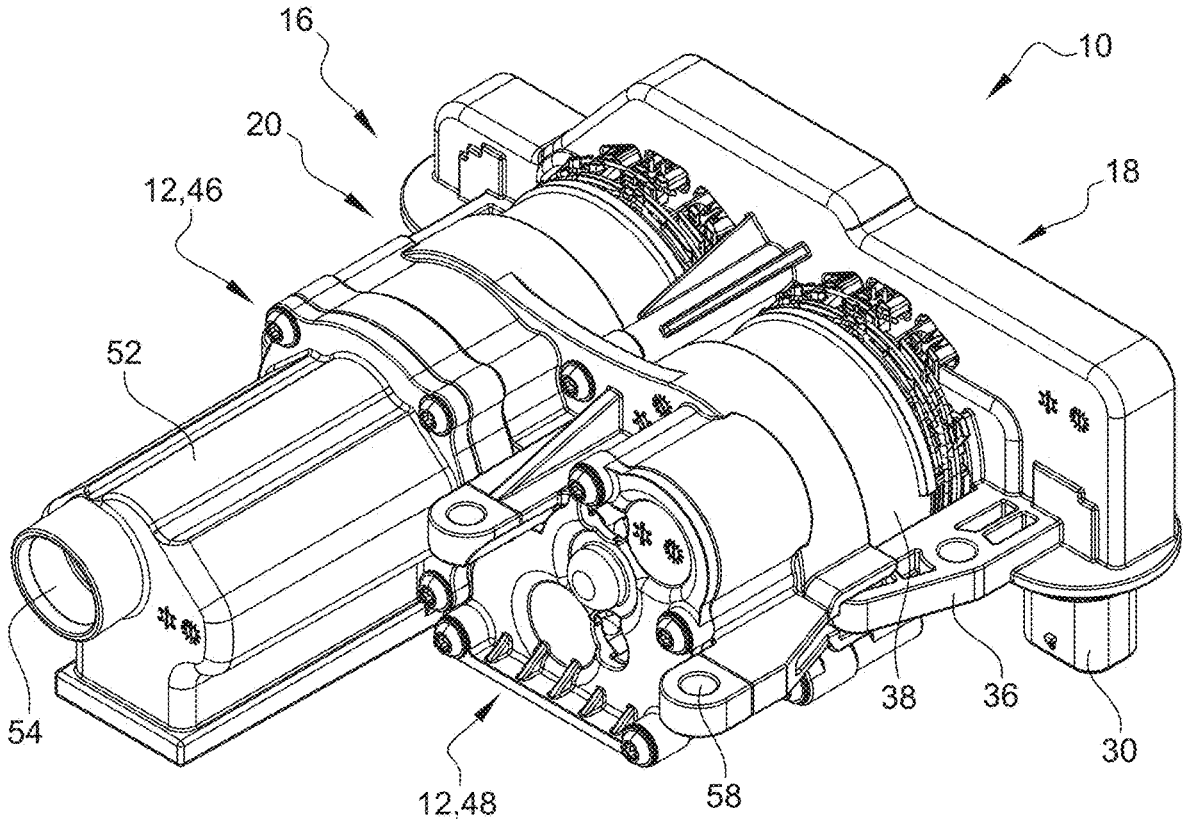
FIG. 1 shows a perspective view of a pump module according to the invention.

FIG. 1 shows a pump module 10 with two hydraulic pumps 12.

Such a pump module 10 is usually installed in motor vehicles, in particular electric vehicles, and serves for lubricating and/or cooling a drive unit.

The pump module 10 is here directly arranged in an oil sump 14. Thus the hydraulic pumps 12 of the pump module 10 can draw in the oil directly from the oil sump 14 and transport it to the drive unit of the motor vehicle.

The pump module 10 has a housing module 16 which has an electronics housing 18 and a pump housing 20.

Figure 2:
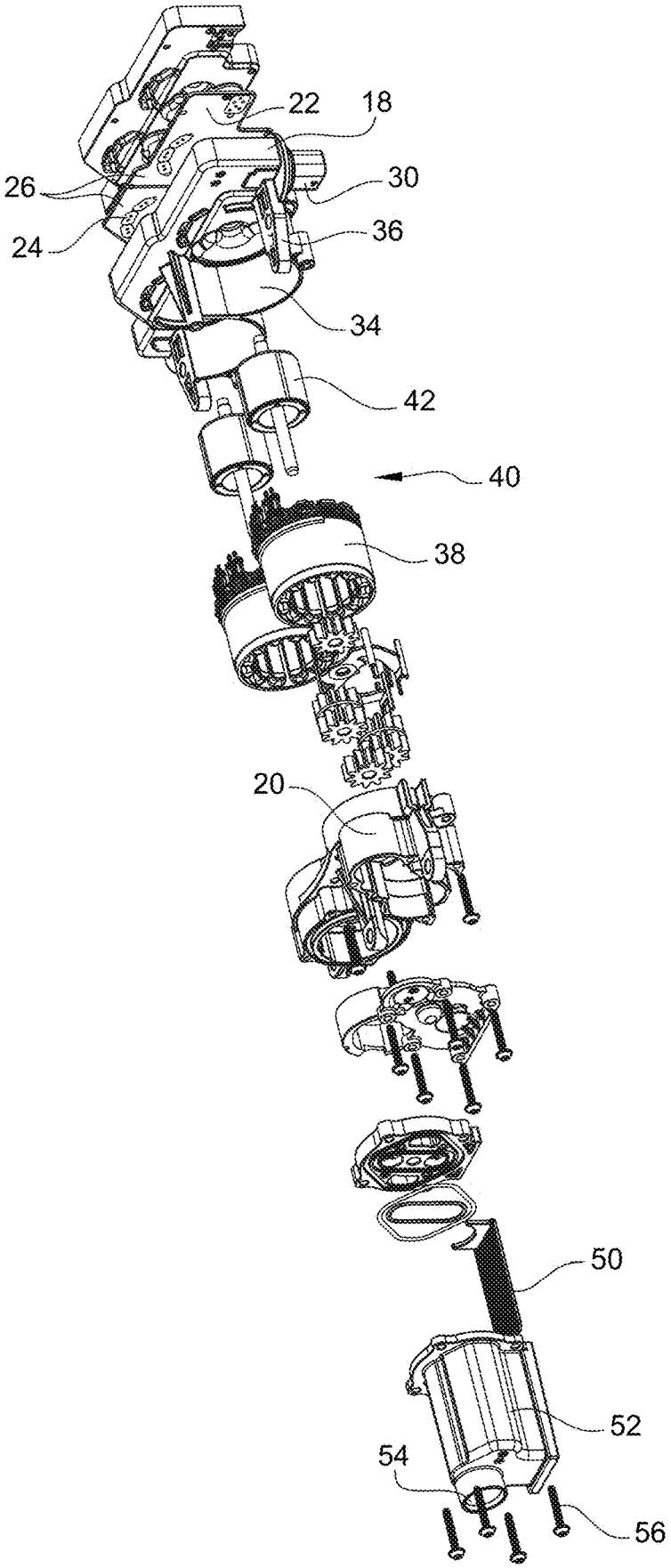
FIG. 2 shows an exploded view of the pump module shown in FIG. 1.
Figure 3:
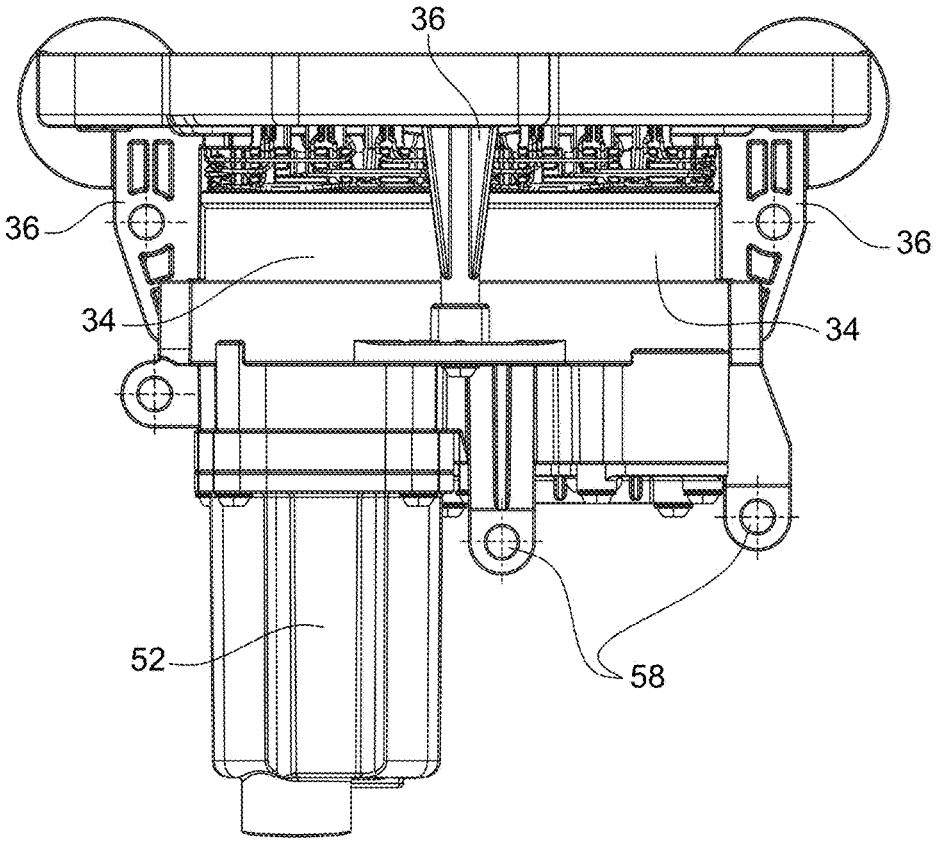
FIG. 3 shows a plan view of the pump module shown in FIG. 1.

As shown in particular in FIG. 2, a circuit board 22 is received in the electronics housing 18. The circuit board 22 is equipped with electronic components 24, by means of which the hydraulic pumps 12 can be actuated.

Preferably, the circuit board 22 is divided into two portions 26 which are separate from one another, so that a portion 26 is assigned to each hydraulic pump 12.

Alternatively, two separate circuit boards 22 may also be provided, which are arranged in the electronics housing 18.

The circuit board 22 is surrounded by a potting compound 28 so that the electronic components 24 are encapsulated fluid-tightly. Thus damage to the electronic components 24 or the entire circuit board 22 can be prevented, even if the pump module 10 is installed directly in the oil sump 14.

If two separate circuit boards 22 are provided, both these circuit boards 22 are embedded in or surrounded by a potting compound 28.

Also, at least one connector plug 30 is provided on the electronics housing 18, making a connection to the other vehicle electronics possible. Such a connection is created via electrical contacts 32 which are situated in the connector plug 30. The electrical contacts 32 may for example be fork contacts. Evidently, any further designs of electrical contacts 32 are also possible. Also, the electrical contacts 32 are connected to the circuit board 22.

The connector plug 30 has a collar 31 on which an O-ring seal can rest. The O-ring seals against the oil sump when the pump module 10 is in fitted state. An opening for each connector plug 30 is provided in the oil sump 14 in which the pump module 10 is fitted, so that the collar 31 seals the opening when the connector plug 30 extends through the opening.

In the embodiment shown in the figures, two connector plugs 30 are provided so that a dedicated connector plug 30 can be assigned to each portion of the circuit board 22. The connector plugs 30 here run parallel to an extent plane of the circuit board 22.

Two trough-like portions 34 are provided on the electronics housing 18, perpendicularly to the extent plane of the circuit board 22. A fastening protrusion 36, via which the electronics housing 18 can be connected to the pump housing 20, is mounted at the respective upper edges of the trough-like portions 34.

A stator 38 of an electric motor 40 is received in each of the trough-like portions 34. The corresponding rotors 42 are each coupled to one of the hydraulic pumps 12.

On the side opposite the electronics housing 18, the stators 38 are inserted into the pump housing 20 over a part of their axial length. Thus the stators 38 are at least partially exposed on an outside of the housing module 16.

The two hydraulic pumps 12 are also arranged in the pump housing 20. In the exemplary embodiment shown, the first hydraulic pump 12 is a vane pump 46 and the second hydraulic pump 12 is a gear pump 48.

Evidently, other hydraulic pumps 12 may also be used. Here, only the pump heads of the hydraulic pumps 12 need be exchanged, since the electric motors 40 and the circuit board 22 are here identical for all hydraulic pumps 12.

Figure 4:
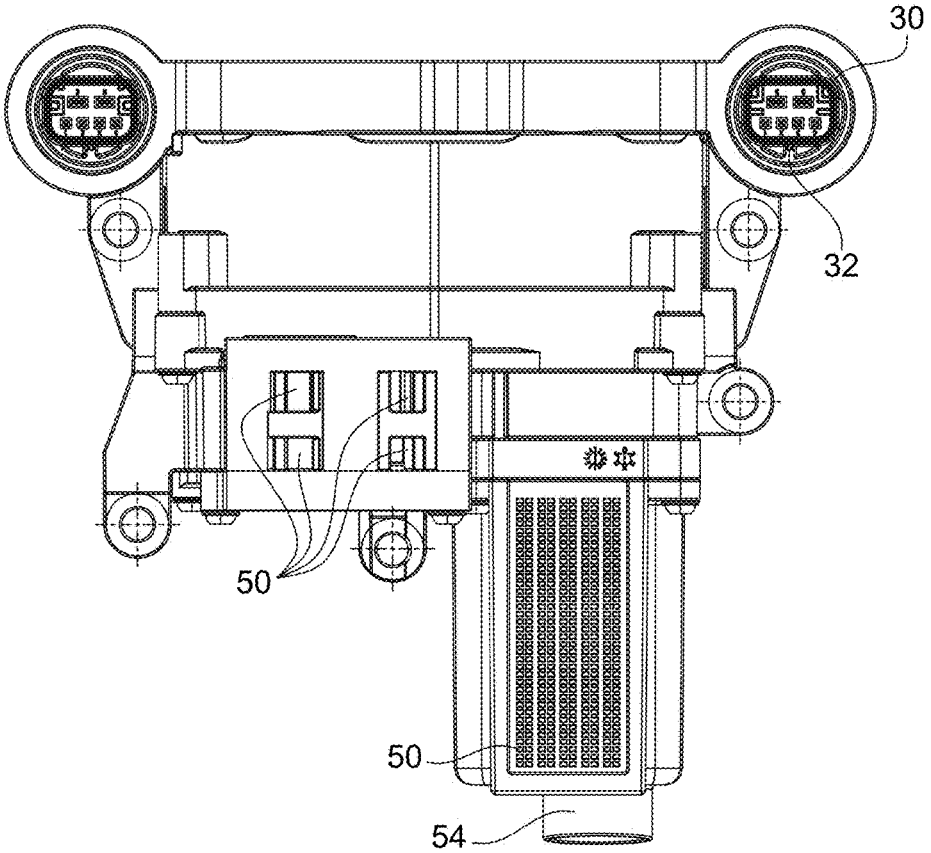
FIG. 4 shows an underside view of the pump module shown in FIG. 1.
Figure 5:
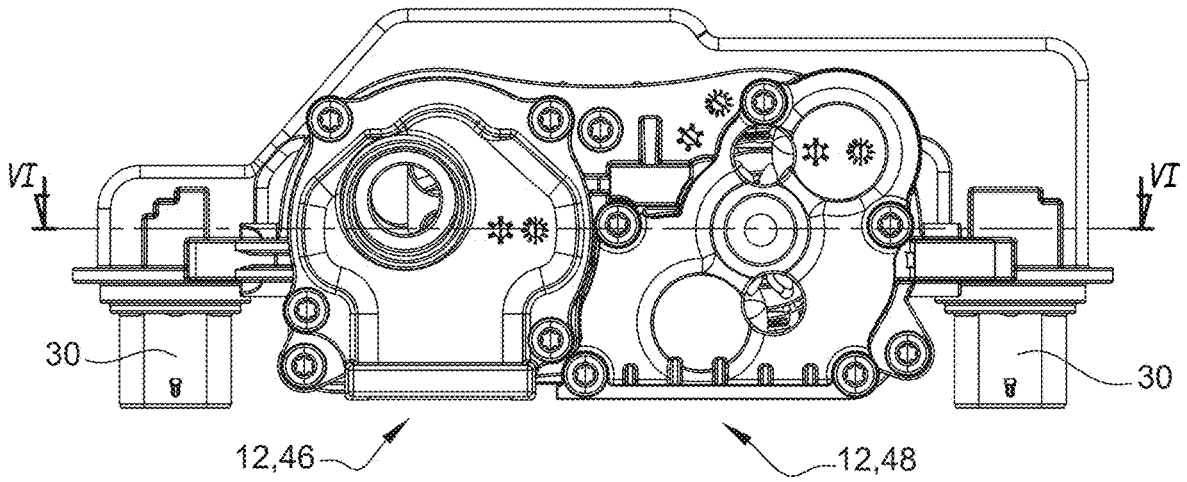
FIG. 5 shows a front view of the pump module shown in FIG. 1.
Figure 6:
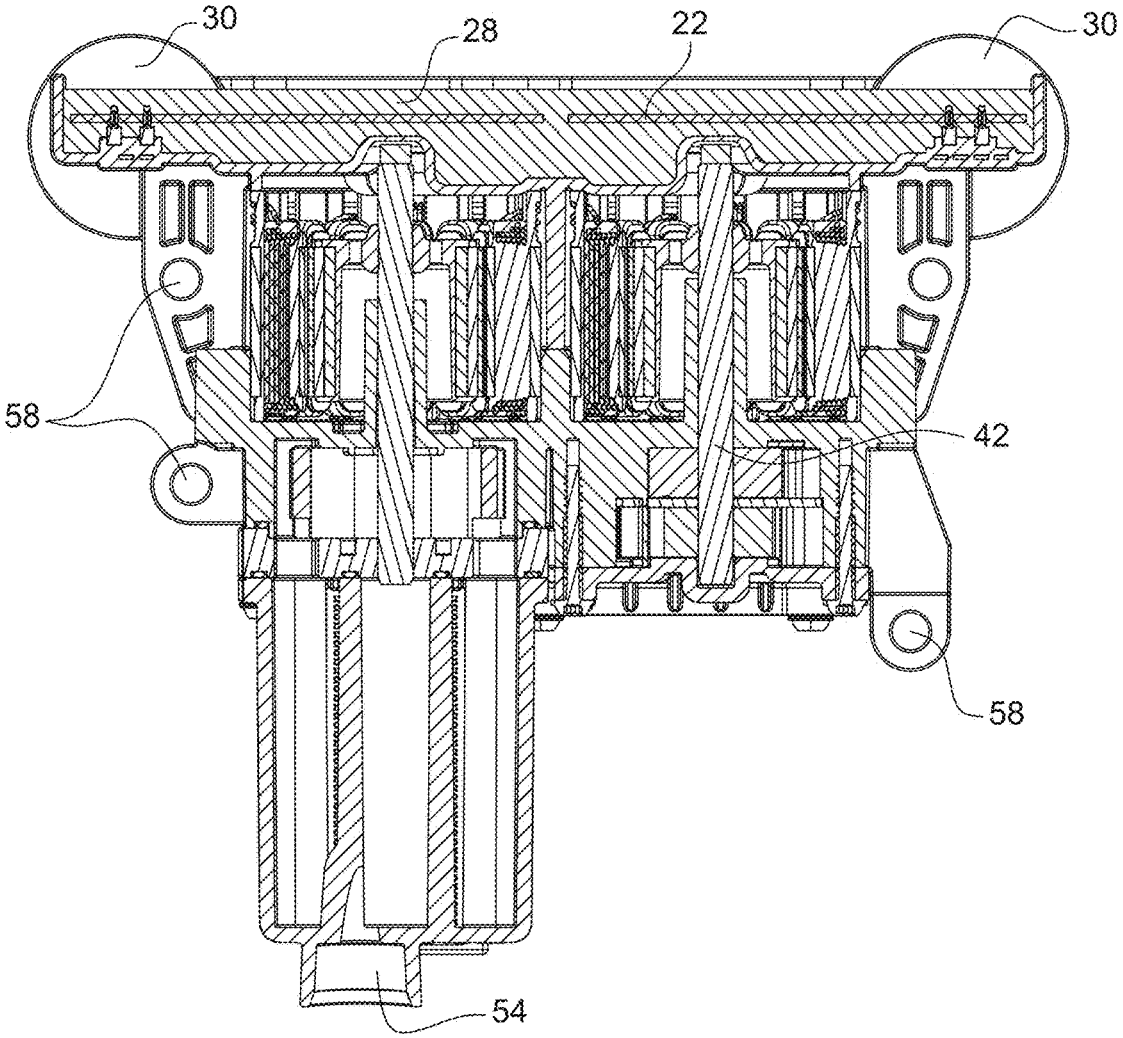
FIG. 6 shows a cross-section along the plane C-C in FIG. 5.
Figure 7:
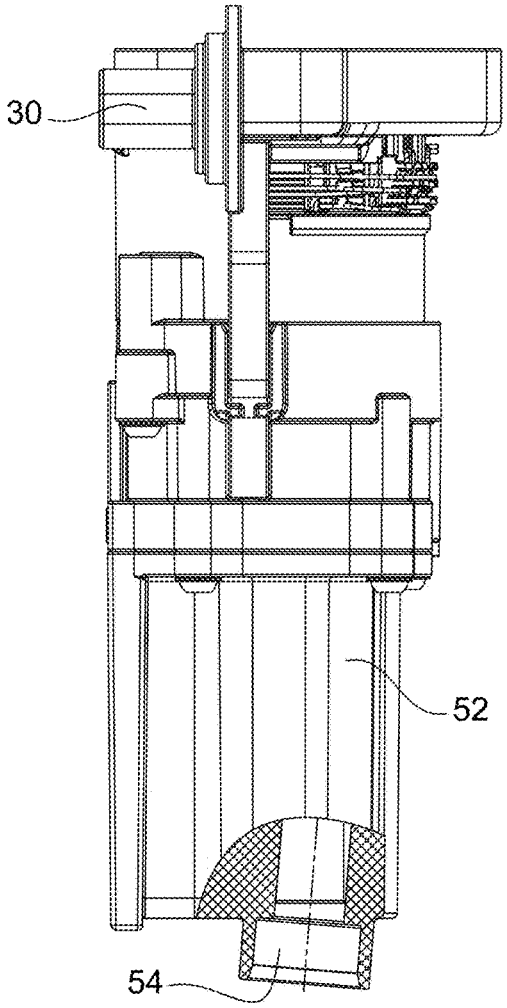
FIG. 7 shows a side view of the pump module shown in FIG. 1.
Figure 8:
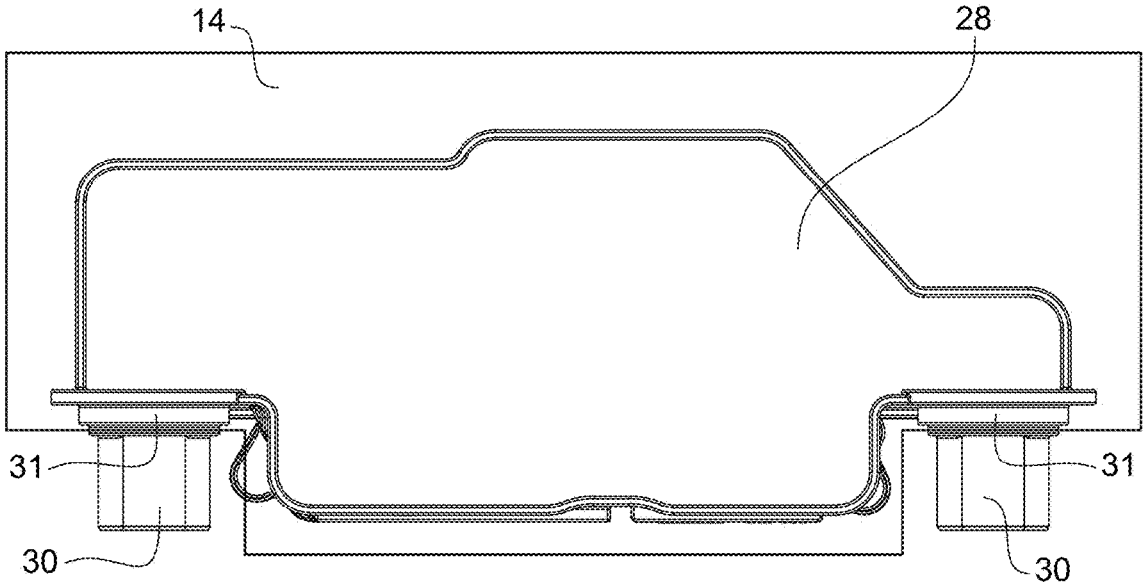
FIG. 8 shows a rear view of the pump module shown in FIG. 1.

As shown in particular in FIG. 4, each of the hydraulic pumps 12 has at least one intake opening 50. FIG. 4 shows that the gear pump 48 has four intake openings 50, wherein the vane pump 46 has one large intake opening 50. Here, all intake openings 50 and also the connector plug 30 are directed towards the same side. In the embodiment shown, all intake openings 50 and the two connector plugs 30 are situated on the same side of the pump module 10, specifically the side which constitutes the underside in fitted state.

Since the vane pump 46 requires a comparatively large intake region, an extension housing 52 is mounted on the pump housing 20 for the vane pump 46. Thus the intake opening 50, which in this case is defined by an injection-moulded filter, is situated on the underside of this extension housing 52.

The filter is pushed into the extension housing and clamped by the screw-mounting of the pump module during fitting.

On a side facing away from the vane pump 46, the extension housing 52 also has a delivery opening 54.

The remaining volume of the extension housing 52 may be used as an oil store so that, despite the additional component, there is no need for a larger oil sump 14.

The electronics housing 18 and the pump housing 20 are connected together in particular via bolts 56. Alternatively, other fastening methods, which guarantee a secure connection of the pump housing 20 and electronics module 18, are evidently also possible.

For fitting the pump module 10 in the oil sump 14, both the electronics housing 18 and also the pump housing 20 have screw openings 58, so that the pump module 10 can be securely fastened and the collar 31 of the connector plug 30 can guarantee a secure seal.

After the electronics housing 18 and the pump housing 20 have been connected together, the rotor 42 extends from the electronics housing 18 through the stators 38 into the pump housing 20, the rotors 42 being connected to the respective hydraulic pump 12.

The pump module 10 thus extends in an axial direction parallel to the rotational axis of the rotor 42 of the electric motor 40. Accordingly, the electronics housing 18 is followed in an axial direction by the electric motors 40, in particular the stators 38 which are received in the pump housing 20, wherein an extension housing 52 extends starting from the pump housing 20.

The invention claimed is:

1. A pump module for a drive unit of a motor vehicle, comprising:

a housing module having an electronics housing and a pump housing, a circuit board which is received in the electronics housing and is equipped with electronic components, a connector plug which is provided on the electronics housing and has electrical contacts which are electrically connected to conductors of the circuit board, and first and second hydraulic pumps which are mounted in the pump housing and each of the first and second hydraulic pumps has an electric motor and at least one intake opening, wherein the pump housing and the electronics housing are separate and distinct from each other, and the pump housing is mounted on an exterior surface of the electronics housing in an axial direction parallel to a rotation axis of the electric motor of one of the first and second hydraulic pumps, wherein the at least one intake opening of the first hydraulic pump, the at least one intake opening of the second hydraulic pump, and the connector plug are all arranged on a common side of the housing module and face a same direction, such that the at least one intake opening of the first hydraulic pump, the at least one intake opening of the second hydraulic pump, and the connector plug are configured to be mounted to an oil sump simultaneously, and wherein a plug-in direction of the connector plug runs parallel to an extent plane of the circuit board.

2. The pump module according to claim 1, wherein the electric motors each have a rotor coupled to one of the first and second hydraulic pumps and a stator received in the pump housing, wherein the stators are at least partially exposed on an outside of the housing module.

3. The pump module according to claim 2, wherein the stators are placed in trough-like portions of the electronics housing.

4. The pump module according to claim 3, wherein the stators are at least partially inserted into the pump housing.

5. The pump module according to claim 2, wherein the stators are at least partially inserted into the pump housing.

6. The pump module according to claim 2, wherein the stators are fixed in the axial direction between the electronics housing and the first and second hydraulic pumps, wherein the first and second hydraulic pumps are bolted to the pump housing.

7. The pump module according to claim 2, wherein the connector plug has a collar which is provided and configured to extend through an opening of an oil sump and seal.

8. The pump module according to claim 2, wherein a plug-in direction of the connector plug runs parallel to an extent plane of the circuit board.

9. The pump module according to claim 2, further comprising another connector plug.

10. The pump module according to claim 2, wherein the circuit board is electrically divided into two portions which are separate from one another, or another circuit board is provided in the electronics housing.

11. The pump module according to claim 1, wherein stators are fixed in the axial direction between the electronics housing and the first and second hydraulic pumps, wherein the first and second hydraulic pumps are bolted to the pump housing.

12. The pump module according to claim 1, wherein the connector plug has a collar which is provided and configured to extend through an opening of an oil sump and seal.

13. The pump module according to claim 1, wherein the first hydraulic pump is a vane pump and the second hydraulic pump is a gear pump, wherein both of the first and second hydraulic pumps have an intake opening facing a same direction as the connector plug.

14. The pump module according to claim 13, wherein one of the first and second hydraulic pumps has an extension housing which has the intake opening on its underside and a delivery opening on a side facing away from the hydraulic pump.

15. The pump module according to claim 13, wherein the electric motors of the first and second hydraulic pumps are identical.

16. The pump module according to claim 1, further comprising another connector plug.

17. The pump module according to claim 1, wherein the circuit board is electrically divided into two portions which are separate from one another, or another circuit board is provided in the electronics housing.

18. The pump module according to claim 1, wherein a potting compound is provided so that the electronic components are encapsulated fluid-tightly in the electronics housing.

19. A pump module for a drive unit of a motor vehicle, comprising:

a housing module having an electronics housing and a pump housing, a circuit board which is received in the electronics housing and is equipped with electronic components, a connector plug which is provided on the electronics housing and has electrical contacts which are electrically connected to conductors of the circuit board, and first and second hydraulic pumps which are mounted in the pump housing and each of the first and second hydraulic pumps has an electric motor, wherein the pump housing is axially mounted on the electronics housing, wherein the electric motors each have a rotor coupled to one of the first and second hydraulic pumps and a stator received in the pump housing, wherein the stators are at least partially exposed on an outside of the housing module, wherein the first hydraulic pump is a vane pump and the second hydraulic pump is a gear pump, and wherein both of the first and second hydraulic pumps have an intake opening facing a same direction as the connector plug.

* * * * *